United States Patent [19]

Galstad et al.

[11] 4,154,392

[45] May 15, 1979

[54] DOOR OPERATED MAILBOX SIGNAL

[75] Inventors: Mark R. Galstad, Redwood Falls, Minn.; Oscar J. Galstad, 307 E. 4th, Redwood Falls, Minn. 56283

[73] Assignee: Oscar J. Galstad, Redwood Falls, Minn. ; a part interest

[21] Appl. No.: 925,460

[22] Filed: Jul. 17, 1978

[51] Int. Cl.[2] ..... A47G 29/12

[52] U.S. Cl. ..... 232/35

[58] Field of Search ..... 232/35, 34, 45, 36, 232/17

[56] References Cited

U.S. PATENT DOCUMENTS

| | | | |
|---|---|---|---|
| 2,864,553 | 12/1958 | Petrie | 232/35 |
| 3,034,706 | 5/1962 | Wing | 232/35 |
| 3,722,460 | 3/1973 | James | 232/35 X |
| 3,891,139 | 6/1975 | Redling | 232/35 |

FOREIGN PATENT DOCUMENTS

| | | | |
|---|---|---|---|
| 259621 | 2/1964 | Australia | 232/34 |

*Primary Examiner*—Francis K. Zugel

*Attorney, Agent, or Firm*—Burd, Braddock & Bartz

[57] ABSTRACT

A rural mailbox has horizontally pivoted signal panels on the front door and on the rear end. These panels move from an "up" position to a "down" position upon the opening and closing of the door as the box is being serviced by a rural mail carrier. In the "up" position, the panels present to view surfaces colored the same as the mailbox. In the "down" position, the panels present surfaces which are in a highly visible color, contrasting with the color of the box. Should ice, sleet and/or snow cause the rear panel to fail to fall by gravity, it is positively forced from the "up" position by the action of an actuator strap as the door is closed. The signal apparatus is reset by hand by the customer at the time the mailbox is emptied by the customer.

7 Claims, 6 Drawing Figures

10
12
14
16
18
20
22
24
26
28
30
31
32
36
38
40
42
44
46

FIG. 4
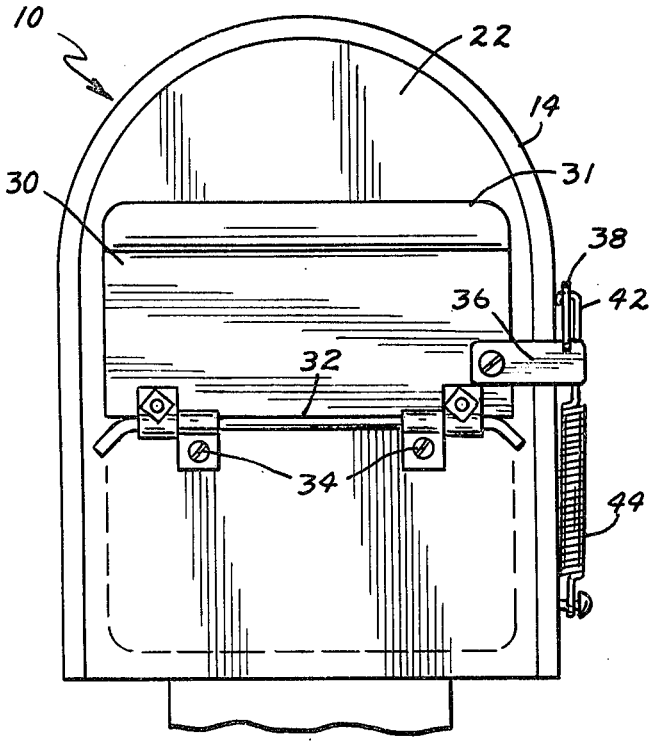
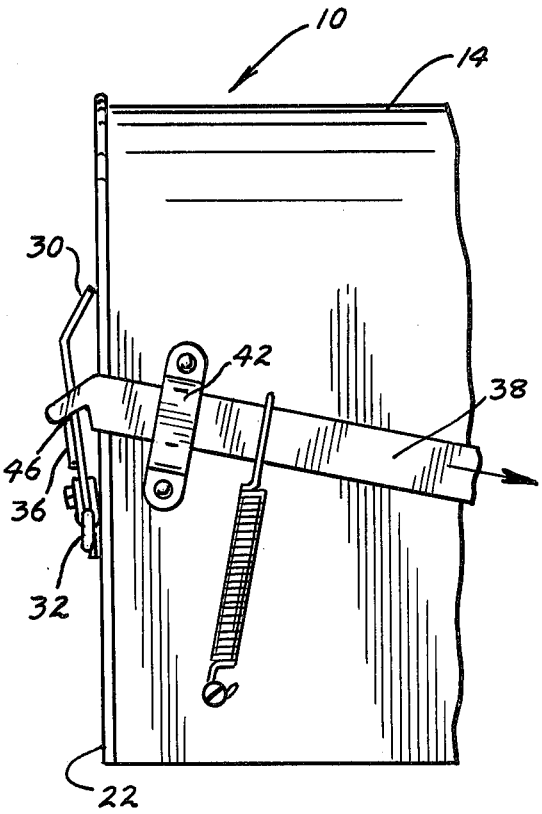
FIG. 5
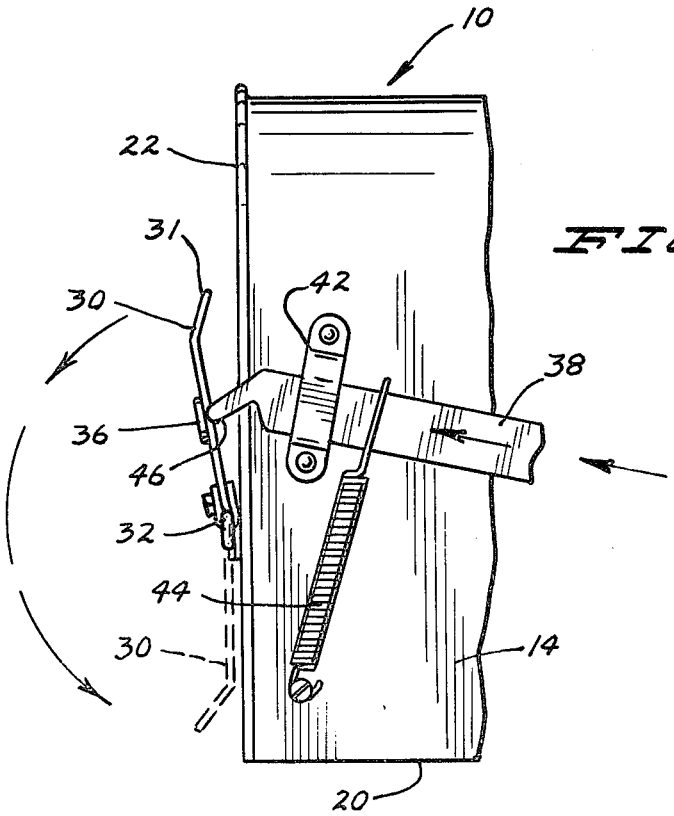
FIG. 6

DOOR OPERATED MAILBOX SIGNAL

BACKGROUND OF THE INVENTION

For many years, and continuing up to the present time, rural mailbox service has been provided with more thought to the convenience and efficiency of the rural carrier than to the rural customer. Rural mailboxes have long been provided with red flags which the customer can elevate to be viewed by the carrier at the time the customer puts mail for pickup into the mailbox. According to the regulations of the United States Postal Service, "rural carriers are required to lower the regular signal flag after collecting mail from the box, but they are not permitted to operate any other signal device. Under these circumstances, customers would know that outgoing mail had been collected but would not know if mail had been delivered."

Under these regulations, all rural mailbox customers who can view the mailbox from their dwellings, who didn't put out mail on a particular day and who don't stand and watch to see whether the carrier stops at the box, must journey to the mailbox to find out whether any mail has been delivered. Obviously this represents hundreds of thousands of unnecessary trips to and from rural mailboxes every day, and represents, overall, an enormous waste of time, energy and productivity.

Under existing regulations, what is needed is a mailbox signal apparatus which will automatically indicate when the mailbox door has been opened and closed again. By and large, this will only happen when the rural carrier deposits mail in the box.

A preliminary search has been made on this invention, and the following patents were located; U.S. Pat. No. 3,722,460, granted to James in March of 1973; U.S. Pat. No. 3,815,811, granted to Harmon in June of 1974; U.S. Pat. No. 3,891,139, granted to Redling in June of 1975; and U.S. Pat. No. 4,018,379, granted to Carter in April of 1977.

The patent to Redling discloses the idea of pivoting a signal panel to the back of a mailbox to have it automatically fall down upon the opening of the front door of the mailbox, the back of the panel being in contrasting color. It is to be noted, however, that Redling lives in Honolulu, Hawaii and that his device depends entirely on operation by gravity after a magnet inside of the mailbox has been moved away from the back end of the box to release the magnetically attractable signal panel. Hopefully this device will be substantially entirely satisfactory in Hawaii, but it is not a satisfactory device for use in the continental United States where the action of snow, sleet and ice must be taken into effect and where a positive action to break the signal panel free from the rear of the mailbox is not only desirable but, in many instances, absolutely necessary to the proper operation of the device.

A further drawback to the Redling device is that it is not applicable as an "add on" to the hundreds of thousands of rural mailboxes now in use.

The patent to James discloses a signal panel which is pivotally mounted below the bottom of the rear end of a rural mailbox and which is, or tends to be, positively forced to pivot when the mailbox door is opened. However, because the signal panel falls below the bottom of the mailbox, the color contrast between the signal panel color and the mailbox color may be lost in certain seasons of the year when the background for the signal panel, when viewed from the customer's abode may be the green of grass, the brown or red of mud, the white of snow or any of the various colors of a roadway. In areas where wind is prevalent during a large portion of many days, the signal panel of James can be expected to be tilted by the wind to a perhaps unviewable or unrecognizable angle. As the James mailbox signal is constructed, wind gusts could conceivably recock the device by swinging the signal panel back up into its upper position to falsely indicate that the mailbox had not been serviced.

The patent to Harmon shows a pivotable "flag member 12" which pivots from horizontal to vertical position when the mailbox door is opened. While this device could obviously be installed on either the right or the left side of the mailbox, it would appear to be useful only on mailboxes where the customer had a good view of one of the flat sides of the mailbox from his dwelling place. As in the case of the previously mentioned James mailbox, the element of color contrast between the "flag member 12" and the color of the mailbox is lost due to the positioning of the flag.

The patent to Carter discloses a signal panel or plate 12 which is upright and in view until such time as the mailbox door is opened and then falls from view upon the opening of the door. The United States Postal Service has set up certain requirements for the use of such devices, and it would appear that the Carter device would not qualify to be permissible.

The regulations of the United States Postal Service relative to such devices as of Feb. 1, 1978 were as follows:

The United States Postal Service does not object to the use of special signal devices for rural mailboxes, designed to indicate to customers that the carrier has served the box, provided it:

1. Does not obstruct or otherwise interfere with the normal operation of the regular flag on the box,
2. Does not interfere with the operation of the door,
3. Does not constitute a hazard to the carrier when serving the box,
4. Does not contain any advertising, and
5. Is not painted red.

The device of the Carter patent, if used along with the regular red flag on the box, would tend to block the view of the regular flag and so to prevent the rural carrier from determining, as he drove along the road, whether the red flag was up. Thus he would not know whether he should make a stop if both flags were in the air and one interfered with the other.

If the device of the Carter patent is to take the place of the regular red flag, then it can only be placed in the air when there is mail to be picked up, and the customer would have no signal available to indicate whether the carrier had stopped at the box if there were not mail for pick up in it.

Once again, the contrast between the signal panel and the color of the rural mailbox is lost where the signal flap or panel is not finally positioned over a portion of the box.

Neither applicant nor those in privity with applicant knows of any prior art closer than that listed above, and knows of no prior art which anticipates the claims of the invention set out herein.

SUMMARY OF THE INVENTION

A signal panel is pivotally mounted on a horizontal pivot pin extending outwardly from a central portion of the front door of a rural mailbox to lie against the mailbox door when it is closed. When the mailbox door is opened by the rural carrier to deposit mail inside, the front panel falls about its horizontal pivot to cover a lower portion of the mailbox door and to disclose a surface of color contrasting with that of the mailbox door.

A similar signal panel is horizontally mounted to an intermediate portion of the rear end of the mailbox, and is held in the "up" position by an actuator strap. The actuator strap is pivotally mounted to a lower portion of the mailbox door, extending along the mailbox and being provided with a rear signal panel holding notch. Bias means is provided to tend to hold the strap down against a signal panel retaining arm which is on the rear signal panel.

When the mailbox door is opened, the actuator strap is pulled away from the retaining arm, allowing the rear signal flap to fall by gravity to cover a rear portion of the rear end of the box and to disclose a color contrasting with the color of the box.

Should ice or sleet or snow prevent the rear signal panel from falling by gravity, as the mailbox door is closed, the actuator strap, acting under the aforesaid downward bias collides with the retaining arm, and positively forces the rear signal flap away from the rear end of the box to allow it to fall.

IN THE DRAWINGS

FIG. 4 is an enlarged rear end elevational view of the mailbox of FIG. 1;

Figures 1, 2, 3:
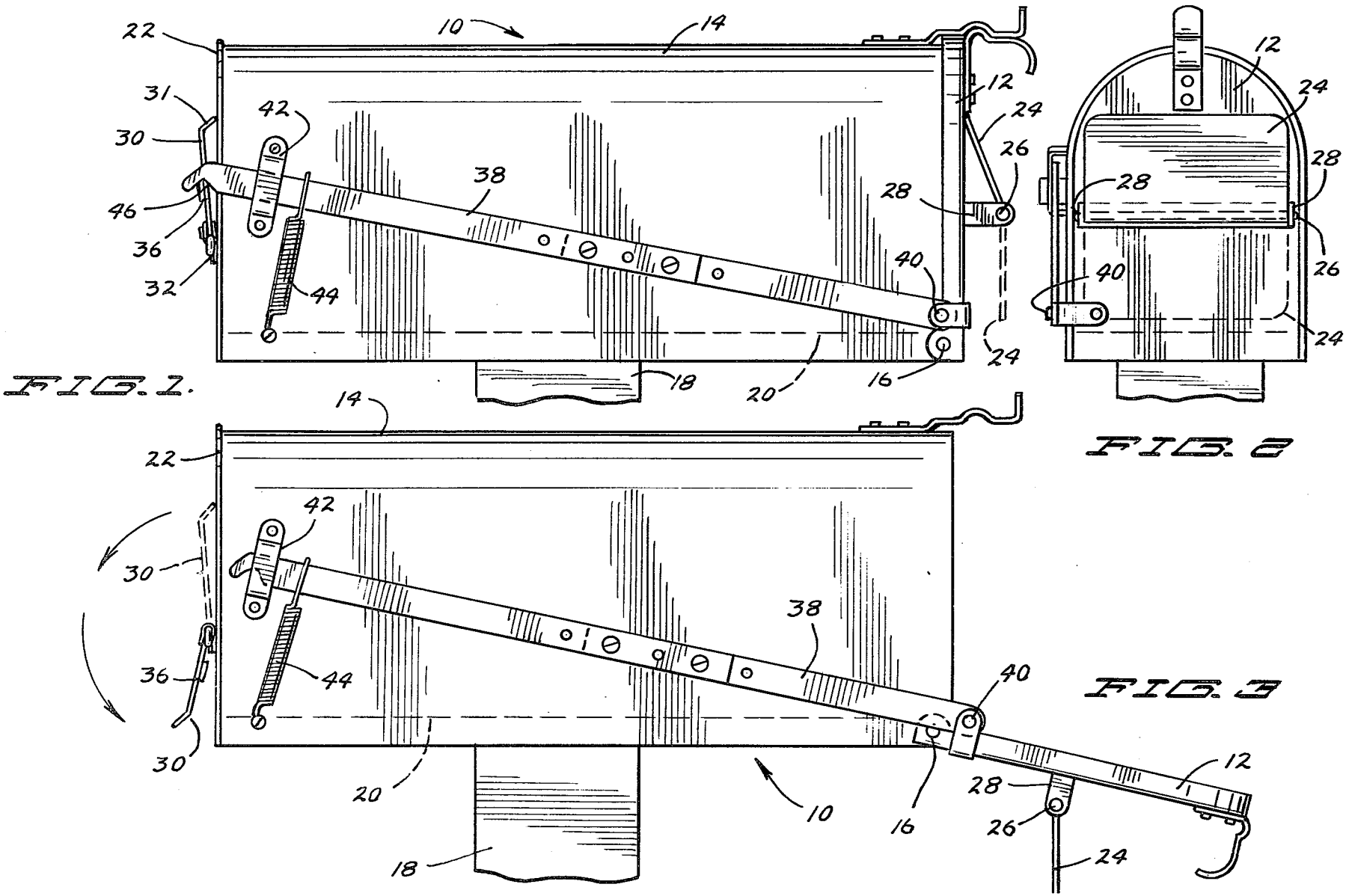
FIG. 1 is a side elevational view of a rural mailbox and the apparatus of the invention with front and rear signal panels shown in the "up" or "empty mailbox " position.
FIG. 2 is a front end elevational view of the mailbox and invention of FIG. 1.
FIG. 3 is a side elevational view of the mailbox of FIG. 1 showing the mailbox door opened for loading by the rural carrier and showing the signal panels moving toward their "down" position.

FIG. 5 is a fragmentary side elevational view of a rear portion of the mailbox of FIG. 1 shown as an actuator strap as being moved to free the rear signal panel as the mailbox door is being opened; and FIG. 6 is a fragmentary side elevational view of a rear portion of the mailbox of the invention as seen in FIG. 5, but showing the action of the actuator strap against a retaining arm of the rear signal panel as the door is being closed, in a situation where the rear signal panel was initially frozen to the rear end of the box.

DESCRIPTION OF PREFERRED EMBODIMENT

A rural mailbox 10 includes a front end door 12 pivoted to a mailbox housing 14 as at 16. Typically the mailbox will sit on a vertical post 18 which is connected to a wooden bottom support (not shown) fastened to a mailbox floor 20. Parallel to the front end door 12 when the door is in the closed position is a permanent mailbox rear end section 22.

The typical and required red flag which the customer puts up into view to indicate that there is mail in the box to be picked up by the carrier has been omitted as it forms no part of the present invention.

All of the foregoing is in accordance with the prior art and exists at hundreds of thousands of rural mailbox locations throughout the United States of America.

The door operated mailbox signal apparatus of the invention includes a front signal panel 24 pivotally mounted on a horizontal pin 26 which is mounted in outwardly extending front door ears 28,28.

A rear signal panel 30 is pivotally mounted on a rear horizontal pivot pin 32 which is bolted to lie in very slightly spaced relation to the mailbox rear end section 22 as at 34,34.

Rear signal panel 30 is provided with lip 31 which holds the panel in over-center free fall relation to pivot pin 32 when in the "up" position, and is provided with a rear signal panel retaining arm 36 which extends outwardly therefrom and past the side edge of the mailbox 10.

A rear signal panel actuator strap 38 is pivotally mounted to front end door 12 as at 40, and extends through actuator strap retaining bracket 42 which holds the strap in close proximity to the side of the mailbox housing 14 but allows it some vertical movement.

As shown, a tension coil spring 44 biases the actuator strap 38 in downward direction, but may other means of bias, including simply the weight of the outer end of the actuator strap would be effective.

Actuator strap 38 is provided with a rear signal panel retaining arm receiving notch 46.

As best seen in FIG. 1, actuator strap 38 can be made adjustable in length so that the apparatus of the invention can be conveniently installed on existing mailboxes of different sizes and lengths.

OPERATION

When the rural postal customer empties his mailbox, he will move the front signal panel to the position as seen in FIGS. 1 and 2; and will move the rear signal panel 30 the position as seen in FIGS. 1 and 4. The rear signal panel actuator strap 38 will be cammed up by the shape of its outer end portion; or can be manually raised to allow the rear signal panel retaining arm 36 to take its position in rear signal panel retaining arm notch 46 provided by the actuator strap 38.

If the rural carrier has nothing to deliver to the rural customer on a particular run, he will not stop, and the parts will stay positioned as seen in FIGS. 1, 2 and 4. Typically in these "up" positions, the signal panels 24 and 30 will display surfaces which are painted with the same paint and/or the same color as that covering the entire mailbox 10.

When the rural carrier has a delivery to make, he will first move the front end door 12 of the mailbox 10 from position as seen in FIGS. 1 and 2 to position as seen in FIG. 3, and the front signal panel 24 will fall by gravity to position as seen in FIG. 3. When the carrier has made his delivery and shuts the door again, the front signal panel 24 will be in the position as seen in dotted lines in FIG. 2, and will present a surface to view which is in a color which contrasts with the color of the mailbox 10.

As the carrier first opens the mailbox door 12, however, the actuator strap 38 will be moved longitudinally in direction as indicated by the arrow in FIG. 5, and the rear signal panel retaining arm notch 46 will cause the actuator arm to ramp up over the rear signal panel retaining arm 36 until it comes clear of that retaining arm 36, and the rear signal panel 30, held in an over-center position by rear signal panel lip 31, will, in good weather, fall normally from the position as seen in FIG. 1 clear past the position seen in FIG. 3. Under icing, snowing, sleeting or even under rusting conditions, the rear signal panel 30 may not be capable of falling by gravity, and so may stay in the dotted position as seen in FIG. 3 even after the actuator strap 38 has reached the position seen in that figure. In that case, as the carrier closes the door, he forces the actuator strap 38 to move in direction as indicated by the arrow in FIG. 6, causing the outer end of the actuator strap to come into contact with the rear signal panel retaining arm 36 to force the rear signal panel 30 away from the mailbox rear end section 22, breaking the ice and sleet and snow free to allow the signal panel 30 to fall to the position as seen in dotted lines in FIG. 6. The surface of the signal panel 30 then presented will be in a color which contrasts with the color of the mailbox 10.

In order to substantially double the visual signal surfaces involved, that portion of the mailbox rear end section 22 and that portion of the front end door 12 which are blocked from view by the signal panels 30 and 24 respectively when they are in the "up" position, can likewise be painted in the contrasting color. Then when the signal panels take their downward position, not only the area of the signal panel will have the contrasting color, but also the area of the mailbox which has been uncovered.

The embodiments of the invention in which an exclusive property or privilege is claimed are defined as follows:

1. A door operated mailbox signal apparatus for use with a mailbox having a housing providing two spaced-apart, parallel upright side walls and a mailbox rear end section, a mailbox front end door pivotally mounted at the bottom thereof to said housing at an end of the housing opposite said mailbox rear end section, said signal apparatus including:

A. a rear signal panel pivotally mounted at one horizontal edge thereof with respect to an intermediate portion of said mailbox rear end section, said rear signal panel being pivotable between an "up" position in substantially parallel, overlying relation with respect to an upper portion of said mailbox rear end section and a "down" position in substantially parallel, overlying relation to a lower portion of said rear end section, said rear signal panel being provided with retaining arm means extending outwardly beyond one of said side walls of said mailbox;

B. an actuator strap slidably mounted with respect to an outer surface of said side wall of said mailbox, and being pivotally mounted with respect to a portion of said front end door to be slidable in forward direction when said door is opened and to be slidable in rearward direction when said door is closed;

C. said actuator strap being provided with means cooperating with said retaining arm means to retain said rear signal panel in said "up" position when said front end door is closed, and to release said rear signal panel as said actuator strap moves clear of said retaining arm means during the opening of said door; and D. said actuator strap being so positioned that, when said rear signal panel remains in said "up" position, the strap will come into contact with that portion of said retaining arm means which extends beyond said side wall of said housing upon movement of said mailbox front end door from open toward closed condition to force said rear panel away from the "up" position.

2. The apparatus of claim 1 wherein:

E. said rear end signal panel is so shaped and so mounted with respect to said rear end section that said rear panel tends to fall by gravity from said "up" position toward said "down" position when said actuator strap moves clear of said retaining arm means.

3. The apparatus of claim 2 wherein:

F. said means for slidably positioning the actuator strap with respect to the side wall of the mailbox includes an actuator strap retaining bracket of configuration to allow limited vertical movement of that portion of the actuator strap within the bracket; and G. said actuator strap means including a retaining arm means receiving notch provided in a lower edge of said actuator strap, and bias means tending to hold said actuator strap at the lowest possible position in said bracket.

4. The apparatus of claim 3 wherein said bias means is constituted as a tension coil spring anchored to said mailbox housing and connected over said actuator strap.

5. The apparatus of claim 3; and

H. a front signal panel freely pivotally mounted with respect to an intermediate portion of said front end door to be pivotal from an "up" position lying against an upper portion of said door and a "down" position lying parallel to the door and in overlying relation to a lower portion of said front end door.

6. The apparatus of claim 1, 2, 3 or 4 wherein the surface of the rear signal panel visible when the panel is in the "up" position is colored to blend with the color of the mailbox; and the surface of the signal panel visible when the panel is in the "down" position is in a color contrasting with the color of the mailbox.

7. The apparatus of claim 5 wherein the surface of the mailbox which is shielded from view by the rear signal panel when in the "up" position is of the same contrasting color as the surface of the signal panel which is in view when it is in the "down" position.

* * * * *